US010479957B2

(12) United States Patent
Roelofs

(10) Patent No.: US 10,479,957 B2
(45) Date of Patent: Nov. 19, 2019

(54) LUBRICANT FOR METAL COLD FORMING PROCESSES AND METHODS OF USE OF THE SAME

(71) Applicant: Freiborne Industries, Inc., Pontiac, MI (US)

(72) Inventor: Robert Ross Roelofs, Allen Park, MI (US)

(73) Assignee: FREIBORNE INDUSTRIES, INC., Pontiac, MI (US)

( * ) Notice: Subject to any disclaimer, the term of this patent is extended or adjusted under 35 U.S.C. 154(b) by 393 days.

(21) Appl. No.: 15/236,687

(22) Filed: Aug. 15, 2016

(65) Prior Publication Data

US 2017/0044458 A1 Feb. 16, 2017

Related U.S. Application Data

(60) Provisional application No. 62/204,640, filed on Aug. 13, 2015.

(51) Int. Cl.
*C10M 173/02* (2006.01)

(52) U.S. Cl.
CPC .... *C10M 173/02* (2013.01); *C10M 2201/061* (2013.01); *C10M 2201/062* (2013.01); *C10M 2201/066* (2013.01); *C10M 2201/083* (2013.01); *C10M 2201/087* (2013.01); *C10M 2201/103* (2013.01); *C10M 2205/022* (2013.01); *C10M 2205/024* (2013.01); *C10M 2205/12* (2013.01); *C10M 2207/126* (2013.01); *C10M 2209/12* (2013.01); *C10M 2217/045* (2013.01); *C10N 2240/405* (2013.01); *C10N 2250/04* (2013.01); *C10N 2250/08* (2013.01); *C10N 2250/121* (2013.01)

(58) Field of Classification Search
CPC ..... C10M 2209/12; C10M 2207/126; C10N 2250/04; C10N 2240/405
See application file for complete search history.

(56) References Cited

U.S. PATENT DOCUMENTS 3,725,274 A * 4/1973 Orozco ..... C10M 7/00 427/398.5

* cited by examiner

*Primary Examiner* — Vishal V Vasisth
(74) *Attorney, Agent, or Firm* — Craig A. Phillips; Dickinson Wright PLLC

(57) ABSTRACT

Disclosed is a lubricant for use in cold forming of a metal. The lubricant comprises a mixture of at least one lubricating compound and at least one starch. The starch adheres the lubricating compound to the metal surface. The present lubricant completely removes the need to pre-coat the metal with a zinc phosphate coating to adhere the lubricating compound to the metal. The present lubricant eliminates several steps required in processes that utilize zinc phosphate pre-coatings. In addition, the lubricant of the present invention is easily removed after the cold forming operations unlike zinc phosphate coatings.

18 Claims, No Drawings

LUBRICANT FOR METAL COLD FORMING PROCESSES AND METHODS OF USE OF THE SAME

RELATED APPLICATIONS

This claims the benefit of U.S. Provisional Application No. 62/204,640 filed Aug. 13, 2015.

STATEMENT REGARDING FEDERALLY SPONSORED RESEARCH

NONE.

TECHNICAL FIELD

This invention relates generally to lubricants and more particularly to lubricant coatings used during cold forming a metal.

BACKGROUND OF THE INVENTION

Metals can be formed by a number of processes including cold forming, warm forming and hot forming. In general cold forming is conducted on metals that are minimally heated if heated at all. The temperature of the metal rises as it is worked, even if the working occurs over a very short period of time. In general, during cold forming of a metal the metal temperature can rise to the range of from 250 to 500° F. In the process of warm forming a metal the metal is first heated in an oven and then formed at a temperature of from 600 to 1800° F. During hot forming the metal is heated to temperatures of 1900° F. and above and then worked.

Cold forming is generally carried out at a room temperature of about 75° F. and can be accomplished using a press, a stamping, or roll forming the metal into a desired shape. The metals can comprise sheets, stacked sheets, bars, billets, wires, bundled wires, pipes, tubing and rolls of metal. Many metals can be cold formed including: steels, stainless steel, aluminum, copper, brass, gold, silver and metal alloys. In one process of cold forming the metal is formed at high speed and high pressure using tool steel or carbide dies. This can be done using single hit or multiple hit tools and multiple tools with different shapes to form the final piece. The cold working of a metal increases the hardness, yield strength, and tensile strength of the formed metal part. Some cold forming processes include multiple strikes of a forming head on the metal in the same die. During cold forming operations it is important that the metal be lubricated to prevent excessive wear of the forming surfaces and tools.

Presently, a metal part to be cold formed is initially cleaned, and then a zinc phosphate conversion coating is applied to the metal. The zinc phosphate conversion coating serves to help subsequently applied lubricant coatings to adhere to the metal. The typical lubricants used include soaps, metal salts of fatty acids, such as sodium stearate. They are typically applied by dipping the part into a heated bath containing the soap. There are several issues with zinc phosphate coatings. Use of zinc phosphate adds several additional steps to the process. Prior to application of the lubricant the metal part must be cleaned, zinc phosphate treated, rinsed, and then optionally subjected to acid neutralization. After the lubricated metal part has been cold formed it is often heat treated to temper it. Prior to the heat treatment it may be necessary to remove any residual zinc phosphate and in particular any residual phosphate. This requires a hot alkaline or acidic cleaning step followed by water rinses. It is believed that any residual phosphate on the metal when it enters the heat treatment can result in the phosphate alloying with the metal surface and that these alloy sites become weak points in the metal. The presence of the phosphate may create a fracture initiation point in the metal causing loss of structural integrity and premature failure of the part. Additionally, the use of phosphate treatment solutions can result in environmental regulation burdens and waste treatment costs to the user.

It is desirable to produce a process of forming a lubricating coating on a metal prior to cold forming the metal that does not require use of zinc phosphate. It is additionally, desirable to a produce a coating that can be removed effectively from the metal after the forming process without leading to structural weaknesses in the formed metal.

SUMMARY OF THE INVENTION

In general terms, this invention provides a method of applying a coating of a lubricant to the metal that does not require the use of zinc phosphate. The coating composition and method eliminates several steps in the typical process and is more economical than the prior art zinc phosphate treatment. The process can be applied to a wide variety of metals and includes a simplified cleaning process.

In one embodiment, the present invention is a lubricant for use in cold forming of a metal comprising: at least one lubricating compound; at least one starch; and wherein the weight:weight ratio of the total amount of lubricating compound to total amount of starch in the lubricant is in the range of from 1:1 to 8:1. The lubricant is preferably prepared in the form of a dry powder. The dry powder can be used as is in dry powder coating box applications or it can be brought up in a heated water bath to form a lubricant coating bath. The lubricant eliminates the need for use of any zinc phosphate pre-treatments and effectively binds the lubricating compound to the metal.

These and other features and advantages of this invention will become more apparent to those skilled in the art from the detailed description of a preferred embodiment. The drawings that accompany the detailed description are described below.

BRIEF DESCRIPTION OF THE DRAWINGS

NONE.

DETAILED DESCRIPTION OF A PREFERRED EMBODIMENT

The present invention is directed toward a lubricant and a process of using the lubricant to apply a lubricant coating to a metal prior to cold forming of the metal. The lubricant in accordance with the present invention comprises a mixture of at least one lubricating compound with at least one starch. The starch functions to bind the lubricating compound to the metal prior to and during the cold forming process. In typical prior art processes the lubrication composition includes as a lubricating compound at least one soap. Typical soaps are metal salts of fatty acids, generally fatty acids of from $C_6$ to $C_{22}$ and preferably fully saturated. The typical soaps can be sodium, potassium, lithium, barium, calcium, aluminum, magnesium, or zinc salts of the fatty acids. The fatty acids can be fully saturated, partially unsaturated and can include hydroxyl functional groups such as in the soap lithium 12-hydroxystearate. The lubricant can include blends of these and other soaps. One important feature of the lubricant according to the present invention is that it must be a solid at a room temperature of approximately 75° F. Thus, the lubricating compounds are chosen, be they one or more soaps or other lubricating compounds, with this criterion in mind. The identity of the metal used to form the soap can influence its melting point as can the length of the fatty acid chain and its degree of unsaturation. In general terms, the melting point increases as the chain length of the fatty acid increases and decreases as the unsaturation increases. Thus a sodium soap of palmitic acid $C_{16}$ has a lower melting point than that of stearic acid $C_{18}$; while stearic acid has a higher melting point than oleic which is also $C_{18}$, but with a single unsaturated bond. In addition to one or more soaps as a lubricating compound the present invention can include other lubricating compounds either alone or in combination with the one or more soaps. Examples of other lubricating compounds that can be used include both inorganic and organic compounds such as: boric acid and its metallic salts, boron nitride; zinc oxide; calcium oxide (lime); molybdenum disulfide; and emulsions of lubricating polymers such as polyethylene, high density polyethylene (HDPE), polypropylene, urethanes, maleated polypropylene, and their oxidized forms.

The present invention comprises a lubricant composed of a lubricating compound, as described herein, in combination with one or more starches. The starch used in the present lubricant serves to bind the lubricating compound to the metal prior to and during the cold forming process. Starches that find use in the present invention include food grade starches, anionic starches and cationic starches as will be described herein. The starches used can be obtained from any source including: corn, potato, wheat, rice, cassava and other common starch sources. Examples of food grade starches that can be used include corn starch such as Clinton 184 from Archer Daniels Midland. In some applications it is preferred that the starch be an anionic starch, also known as oxidized starch, and examples from Archer Daniels Midland include Clinco 430, and Clinton 441. In some applications it is preferred that the starch be a cationic starch, an example from Archer Daniels Midland is Clin-Cat 830. In other examples modified starches such as hydroxyethyl starches like Clineo 718 and 706 from Archer Daniels Midland can be used. Preferably the starches used in the present invention have anhydrous melting points that are similar to sodium stearate, in the range of about 473 to 491° F., which is in the temperature range a metal can reach during cold working.

As known to those of skill in the art, it is desirable that the applied lubricant dry film flow with the metal as it is deformed in the cold working process to fully coat the metal. Thus, the lubricant has to have an appropriate melting or softening temperature and a viscosity over the temperatures reached during the cold forming process to allow the lubricant to flow over the entire piece of metal being formed. When the bare metal to be formed is in the physical form of bundled or wrapped wires, the lubricant needs to able to penetrate into all the spaces around the wires and between the coils and wires making up the bundle during the lubricant application process. This requires a balance between melting or softening temperatures and viscosity of the lubricant. If the viscosity is too low the lubricant will flow completely off the metal and provide no lubrication. If the viscosity is too high the lubricant will clump and not coat the metal uniformly. The desire is to provide a lubricant coating that is thick enough to provide lubrication and thin enough to flow without running off the metal piece. In a preferred embodiment the lubricant composition is a dry powder comprising the one or more lubricating compounds and the one or more starches. Preferably the ratio of total lubricating compound to total starch is in the range of from 1:1 to 8:1, more preferably from 2.5:1 to 4:1 on a weight:weight ratio.

In one embodiment, the lubricant powder can be used in a dry lubricant box wherein the metal to be coated is pulled through the box to coat it with the lubricant prior to cold forming the metal. Typically, such dry box lubricating systems are used to coat metal in the form of one or more wires. The friction as the wire is pulled through the dry box is sufficient to melt the lubricant powder, coat the wire and then have the lubricant coating re-solidify on the wire as it exits the box. In another embodiment the present invention is used in a lubricant coating bath to coat the metal with the lubricant. When used in a coating bath the main component of the bath is typically water and the lubricant composition is added as a dry powder and allowed to fully hydrate. The water is typically kept at a temperature of from 160 to 190° F. This temperature range allows the starch to fully hydrate and for the lubricant compound to assemble into micelles that are believed to be trapped in a matrix of the hydrated starch molecules. The hydrated lubricating compound and starch mixture has a lower softening/melting temperature than the anhydrous forms of the lubricating compound and the starch so the bath temperature fully melts and or solubilizes the lubricating compound and starch. The hydrated starch and lubricating compound composition does not exhibit any phase separation. The viscosity of the lubricating bath is also a function of its temperature, if the temperature is too low, below about 160° F., the viscosity is too high and the bath will have lumps of starch and lubricating compound in it. When the bath temperature exceeds about 190° F. the viscosity is too low and the lubricant is not able to effectively adhere to the metal. Preferably the lubricating bath temperature is from about 165 to 185° F. This allows for full hydration of the lubricant components and sufficient viscosity to permit the lubricant to penetrate all throughout the metal irrespective of its shape and to adhere in a sufficiently thick enough layer. Additionally, as known to those of skill in the art the size, starting temperature and heat retention characteristics of the metal part being coated with the lubricant can also influence the preferred viscosity of the lubrication bath.

In the typical process according to the present invention, once the metal has been indexed to the lubricant application tank it is dipped into the hot lubricant bath, held for a period of time in the bath, removed from the bath which cools the coating sufficiently enough to allow it to harden onto the metal and to flash the water off the piece, and then the process is repeated several times to build up a lubricant coating on the metal. Usually a soaking time of 30 seconds to 4 minutes and 2 to 4 cycles is sufficient to coat a metal piece irrespective of its shape. As known to those of skill in the art, these times can be varied by wide ranges and depend on factors such as the shape of the metal piece, the temperature of the metal piece as it enters the lubricating bath, the heat conductance of the metal being coated, size of the bath relative to the size of the metal being coated, and the viscosity of the lubricant composition. If the coating layer is too thin, then when the metal is re-inserted into the bath the previous coating can be melted off if immersed too long and thus no or very little coating builds on the metal thus reducing the ability to act as a lubricant when the piece is later cold formed. The bath pH is preferably in the range of from 7 to 10, more preferably from 7 to 9. Preferably the total level of lubricating compound in the lubricating bath ranges from 3 to 15% on a weight percentage basis based on the total weight of the lubricant bath solution, which is aqueous based. Preferably, whether applied via a dry powder coating box, as a spray lubricant as described below or via a lubricating bath the amount of lubricant applied to the metal substrate ranges from 250 to 2000 mg/square foot dry coating weight.

The lubricant composition can include other optional components and preferably these are at a total level of about 5% by weight or less in the dry powder based on the total dry powder weight. These optional components can include: surfactants; corrosion inhibitors; processing aids; bactericidal and bacteriostatic agents; fungi static and fungicidal agents; defoaming agents; viscosity modifiers; and pH buffering agents.

Examples of surfactants can include amphoteric surfactants, anionic surfactants, cationic surfactants and non-ionic surfactants. The selected surfactants must be soluble in the bath and preferably are low foaming. Examples include: nonionic surfactants such as alcohol ethoxylates, for example Antarox® BL225 from Rhone Poulenc; anionic surfactants from Rhone Poulenc such as sodium 2-ethylhexylsulfate (Rhodapon® BOS) or sodium octyl sulfate (Rhodapon® OS); and amphoteric surfactants from Rhone Poulenc such as alkylether hydroxypropyl sultaine (Mirataine® ASC) or aminopropionates such as Mirataine® JC-HA. Any surfactant can be used so long as it does not interfere with the lubricant coating bath process. These surfactants also drive out air in the metal shapes which would prevent the lubricant coating from fully coating the metal piece. These surfactants can also be used in a pre-rinse solution, as described below, as well as in the lubricant composition. Typically, they are used at levels of about 0.3% weight/volume in the pre-rinse bath or the lubricating bath. The actual level used is adjusted as required and as known by those of skill in the art to provide a sufficient surface effect.

Examples of corrosion protection agents include: sodium nitrite; sodium gluconate; amines such as monoethanolamine, triethanolamine, 2-amino-2-ethyl-1,3 propanediol (AEPD), 2-amino-2-methyl-1-propanol (AMP); triazoles such as tolytriazole and benzotriazole; borated amines; carboxylic acid amines such as Hostacor 2098 from Clariant; and mixtures of ethanolamine and triethanolamine. These are used to control short term corrosion that might occur during flashing off of the water. They are used at levels as required by the specific bath conditions and in general should be used sparingly as known to those of skill in the art. Typically they are used at levels of from 500 to 1500 ppm in the bath.

Examples of processing aids include clays and zinc borate. These processing aids act as viscosity modifiers and are therefore helpful in developing a uniform lubricant coating. One example of a suitable clay is a hectorite clay such as is available from Elementis Specialties of New Jersey. Other types of clay are also suitable. Preferably the clay is used at a level of 0.5% to 2.5% by weight based on total lubricant weight. The zinc borate can be obtained from multiple sources including Akrochem Corporation of Ohio. Preferably the zinc borate is used at a level of from 0.1 to 1.0% by weight based on the total lubricant weight.

Examples of bactericidal and bacteriostatic agents and fungi static and fungicidal agents that can be used include: sodium hydroxide; 1,2-benzisothiazolin-3-one, Proxel™ GXL from LONZA corp; and hexahydro-1,3,5-tris(2-hydroxyethyl)-s-triazine, Grotan® from Troy Chemical company. When added to the bath itself they are typically used at levels of from 750 to 1800 ppm, in the lubricant powder concentrate they are present at levels of from 1.5 to 3.0% by weight.

The present invention finds use in coating all metals including: steel, stainless steel, aluminum, copper, brass, gold, silver, nickel, palladium, platinum, tantalum, tin, titanium, or an alloy of two or more metals. The metal can be in any form desired including: as a wire, bundled wires, billets, bars, single sheets, stacked sheets, tubes, pipes, and rolled coils. It has been found that cationic starches work especially well on aluminum metal parts and anionic starches work especially well on steel based metal parts, the reasons why are not known.

The typical process steps according to the present invention comprise cleaning the metal, rinsing it, surface treating and acid neutralization of the metal, coating with the lubricant. After allowing the wet lubricant film to dry it is sent to the cold forming tool. The cleaning of the metal is usually done in mineral acids, like sulfuric acid, to remove rust and oxidation. Alternatively, shot blasting, sanding and wire brush cleaning can also be used to clean the metal. This is followed by several water rinses to remove the acid or particulate. Preferably, the metal is pre-conditioned in a hot, 165 to 185° F., pre-rinse solution containing at least one surfactant, generally at 0.3% weight/volume, and an acid neutralizing agent such as sodium carbonate (0.25% weight/volume) in the rinse to neutralize the surface of the metal and to ensure full penetration of the lubricant. Importantly, the metal part does not have a zinc phosphate coating applied to it prior to the application of lubricant as in the prior art. The metal part is then indexed to the lubricating bath, which is at a temperature of 165 to 185° F., and dipped into the bath with a soaking for a period of time. The part is removed to cool the part, flash off the water and form a first layer of lubricant on the metal part. This process is repeated several times to build up a sufficiently thick enough layer of lubricant on the metal part. The lubricant coated metal part is then sent to the cold forming machine to be formed. After the metal has been formed, any residual lubricant can be removed by washing the part in a hot, over 190° F., water bath or in a bath containing a cleaning compound. Alternatively the residual lubricant coating can be burned off in a heat treatment step following the cold forming. These methods of removing the remaining lubricant can be used whether the lubricant is applied via a dry powder box, lubricant bath or spray applied as detailed herein. The present lubricant adheres sufficiently to metals that it can also be used as a coating wherein the metal is coated with the lubricant and then stored for a period of time prior to being cold formed. For example a coiled steel part can be uncoiled, coated with the lubricant and then stored either uncoiled or re-coiled for a period of time prior to the cold forming step.

Several examples of lubricant compositions illustrating the present invention are found in Table 1 below, the levels are in terms of weight % based on the total weight of the aqueous bath. So a 10% addition means 10 pounds of the component per 100 pounds final weight of aqueous bath solution. The components in Table 1 were added to water to form an aqueous lubricant bath solution, the rest of the weight being made up of water to 100%.

TABLE 1

| Component | Ex 1 | Ex 2 | Ex 3 | Ex 4 | Ex 5 | Ex 6 | Ex 7 | Ex 8 | Ex 9 |
|---|---|---|---|---|---|---|---|---|---|
| Na Stearate | 6% | 6% | 9% | 6% | 6% | | 6% | 9% | 7% |
| Zn Stearate | | | | | | | | 1.5% | 0.5% |
| Al Stearate | | | | | | | | 0.75% | |
| Corn starch, food grade | 6% | 3% | | | | | | | |
| Anionic starch | | | 3% | | | | 1.5% | 3% | 4.5% |
| Cationic starch | | | | 3% | | | 1.5% | | |
| Hydroxyethyl starch 1 | | | | | 1.5% | 3% | | | |
| Hydroxyethyl starch 2 | | | | | 1.5% | 3% | | | |
| Clay | | 1% | | | | | 1% | | |
| Zinc Borate | | | | | | | | | 0.2% |
| Na Nitrite | | 0.5% | 0.3% | | 0.5% | | | | |
| Surfactant | | | 0.3% | | | | | | 0.2% |
| Polypropylene polymer | | | | | | 7% | | | |
| Polyethylene polymer | | | | | | 7% | | | |

Examples 1-3 and 9 were coated onto steel based metal parts, examples 4 and 5 were coated onto aluminum substrates, and examples 6-8 were coated onto multiple substrates. All of the coatings were effective in coating the metal parts with a lubricant coating including those parts with complex geometries and those involving bundled wires or rods. The coatings all adhered well to the metal parts and provided effective lubrication to the metal parts during a variety of cold working processes. As another advantage, the coatings were easily removed by combustion when the formed metal parts were subsequently heat treated. This eliminates a cleaning step required when zinc phosphate has been used. Alternatively, if no heat treatment is to be performed on the formed metal part any residual lubricant can be removed by a hot water rinse or a cleaning solution. In another example a sprayable lubricant composition was formed by combining isopropyl alcohol as a carrier solvent with 0.25% by weight of anionic starch and 0.25% by weight of boron nitride. The lubricant components become solubilized in the isopropyl alcohol carrier and the lubrication composition can be spray applied to metal parts prior to cold forming. The isopropyl alcohol carrier evaporates leaving behind the lubricating composition and the starch adheres the boron nitride to the metal part. Other inorganic lubricants in place of or in addition to boron nitride could be used and the carrier vehicle could be another volatile vehicle other than isopropyl alcohol. The spray applied lubricant formulation is also preferably applied to a dry coating weight level of from 250 to 2000 mg/square foot onto any metal surface that it is applied to.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

I claim:

1. A lubricant for use in cold forming of a metal consisting essentially of:

one or more lubricating compounds selected from the group consisting of a soap that is a metal salt of a $C_6$ to $C_{22}$ fatty acid, a soap that is a metal salt of a $C_6$ to $C_{22}$ fatty acid containing one or more hydroxyl function groups, boric acid, a metal salt of boric acid, boron nitride, zinc oxide, calcium oxide, molybdenum disulfide, an emulsion of polyethylene, an emulsion of high density polyethylene, an emulsion of polypropylene, an emulsion of maleated polypropylene, an emulsion of a urethane, an emulsion of an oxidized polyethylene, an emulsion of an oxidized high density polyethylene, an emulsion of an oxidized polypropylene, an emulsion of an oxidized maleated polypropylene, an emulsion of an oxidized urethane, and mixtures thereof;

one or more starches;

wherein a weight:weight ratio of a total amount of said one or more lubricating compounds to a total amount of said one or more starches in said lubricant is in a range of from 1:1 to 8:1;

optionally, including at least one additional component selected from the group consisting of a surfactant, a corrosion inhibitor, a processing aid, a bactericidal agent, a bacteriostatic agent, a fungistatic agent, a fungicidal agent, a defoaming agent, a viscosity modifier, a pH buffering agent, or mixtures thereof, wherein a total amount of said at least one additional component does not exceed 5% by weight based on a total weight of said lubricant; and wherein said lubricant is a solid at 75° F.

2. The lubricant as recited in claim 1, wherein said one or more starches is selected from the group consisting of a food grade starch, an anionic starch, a cationic starch, a modified starch, and mixtures thereof.

3. The lubricant as recited in claim 2 wherein said one or more starches is sourced from a corn starch, a potato starch, a wheat starch, a rice starch, a cassava starch, or a mixture thereof.

4. The lubricant as recited in claim 1, wherein each of said one or more starches has an anhydrous melting point of from 473 to 491° F.

5. The lubricant as recited in claim 1, wherein at 75° F. said lubricant is a solid in powder form.

6. The lubricant as recited in claim 1, wherein said one or more lubricating compounds is selected from the group consisting of a soap that is a metal salt of a $C_6$ to $C_{22}$ fatty acid, a soap that is a metal salt of a $C_6$ to $C_{22}$ fatty acid containing one or more hydroxyl function groups, a metal salt of boric acid, and mixtures thereof; and wherein the metal salt is selected from the group consisting of sodium, potassium, lithium, barium, calcium, aluminum, magnesium, zinc and mixtures thereof.

7. The lubricant as recited in claim 1, further comprising a positive amount of at least one additional component selected from the group consisting of a surfactant, a corrosion inhibitor, a processing aid, a bactericidal agent, a bacteriostatic agent, a fungistatic agent, a fungicidal agent, a defoaming agent, a viscosity modifier, a pH buffering agent, or mixtures thereof, wherein the total amount of said at least one additional component does not exceed 5% by weight based on a total weight of the lubricant.

8. The lubricant as recited in claim 1, further comprising a volatile carrier wherein said lubricant is solubilized in said volatile carrier and wherein said lubricant thereby becomes a sprayable lubricant.

9. A method of coating a metal with a lubricant prior to cold forming the metal comprising the steps of:

a) providing a lubricant consisting essentially of one or more lubricating compounds selected from the group consisting of a soap that is a metal salt of a $C_6$ to $C_{22}$ fatty acid, a soap that is a metal salt of a $C_6$ to $C_{22}$ fatty acid containing one or more hydroxyl function groups, boric acid, a metal salt of boric acid, boron nitride, zinc oxide, calcium oxide, molybdenum disulfide, an emulsion of polyethylene, an emulsion of high density polyethylene, an emulsion of polypropylene, an emulsion of maleated polypropylene, an emulsion of a urethane, an emulsion of an oxidized polyethylene, an emulsion of an oxidized high density polyethylene, an emulsion of an oxidized polypropylene, an emulsion of an oxidized maleated polypropylene, an emulsion of an oxidized urethane, and mixtures thereof and one or more starches, wherein a weight:weight ratio of a total amount of the one or more lubricating compounds to a total amount of the one or more starches in the lubricant is in a range of from 1:1 to 8:1, the lubricant, optionally, including at least one additional component selected from the group consisting of a surfactant, a corrosion inhibitor, a processing aid, a bactericidal agent, a bacteriostatic agent, a fungistatic agent, a fungicidal agent, a defoaming agent, a viscosity modifier, a pH buffering agent, or mixtures thereof, wherein a total amount of the at least one additional component does not exceed 5% by weight based on a total weight of the lubricant and wherein the lubricant is a solid at 75° F.; and b) applying the lubricant to a surface of a metal substrate wherein the metal substrate does not have a coating of zinc phosphate prior to application of the lubricant.

10. The method according to claim 9, wherein step a) comprises providing a lubricant wherein the one or more starches are selected from the group consisting of a food grade starch, an anionic starch, a cationic starch, a modified starch, and mixtures thereof.

11. The method according to claim 9, wherein step a) comprises providing a lubricant wherein each of the one or more starches is selected to have an anhydrous melting point of from 473 to 491° F.

12. The method according to claim 9, wherein step a) comprises providing a lubricant wherein the one or more lubricating compounds is selected from the group consisting of a soap that is a metal salt of a $C_6$ to $C_{22}$ fatty acid, a soap that is a metal salt of a $C_6$ to $C_{22}$ fatty acid containing one or more hydroxyl function groups, a metal salt of boric acid, and mixtures thereof and wherein the metal salt is selected from the group consisting of sodium, potassium, lithium, barium, calcium, aluminum, magnesium, zinc and mixtures thereof.

13. The method according to claim 9, wherein step a) further comprises providing a lubricant with a positive amount of at least one additional component selected from the group consisting of a surfactant, a corrosion inhibitor, a processing aid, a bactericidal agent, a bacteriostatic agent, a fungistatic agent, a fungicidal agent, a defoaming agent, a viscosity modifier, a pH buffering agent, or mixtures thereof, wherein the total amount of the at least one additional component does not exceed 5% by weight based on a total weight of the lubricant.

14. The method according to claim 9, wherein step a) further comprises providing the lubricant as a solid powder in a dry powder coating box and wherein step b) comprises pulling the metal substrate through the dry powder coating box at least one time to thereby apply the lubricant to the surface of the metal substrate.

15. The method according to claim 9, wherein step a) further comprises providing the lubricant in a bath at a temperature of from 160 to 190° F., wherein the lubricant is a liquid in the bath; and wherein step b) comprises placing the metal substrate in the bath for a period time, removing the metal substrate from the bath and allowing the lubricant to solidify on the surface of the metal substrate.

16. The method according to claim 15, wherein the bath further comprises water and the lubricant with the lubricant present in an amount of from 3 to 15% by weight based on the total weight of the bath and wherein during step b) the water is flashed off as the metal substrate is removed from the bath and the lubricant forms a solid coating on the metal.

17. The method according to claim 9, wherein step b) comprises applying the lubricant to a metal substrate selected from the group consisting of steel, stainless steel, aluminum, copper, brass, gold, silver, nickel, palladium, platinum, tantalum, tin, titanium, or an alloy of two or more metals.

18. An article of manufacture comprising:

a metal substrate having a surface; and a lubricant coated onto said surface of said metal substrate, said lubricant consisting essentially of one or more lubricating compounds selected from the group consisting of a soap that is a metal salt of a $C_6$ to $C_{22}$ fatty acid, a soap that is a metal salt of a $C_6$ to $C_{22}$ fatty acid containing one or more hydroxyl function groups, boric acid, a metal salt of boric acid, boron nitride, zinc oxide, calcium oxide, molybdenum disulfide, an emulsion of polyethylene, an emulsion of high density polyethylene, an emulsion of polypropylene, an emulsion of maleated polypropylene, an emulsion of a urethane, an emulsion of an oxidized polyethylene, an emulsion of an oxidized high density polyethylene, an emulsion of an oxidized polypropylene, an emulsion of an oxidized maleated polypropylene, an emulsion of an oxidized urethane, and mixtures thereof and one or more starches, wherein a weight:weight ratio of a total amount of said one or more lubricating compounds to a total amount of said one or more starches in said lubricant is in a range of from 1:1 to 8:1, said lubricant, optionally, including at least one additional component selected from the group consisting of a surfactant, a corrosion inhibitor, a processing aid, a bactericidal agent, a bacteriostatic agent, a fungistatic agent, a fungicidal agent, a defoaming agent, a viscosity modifier, a pH buffering agent, or mixtures thereof, wherein a total amount of said at least one additional component does not exceed 5% by weight based on a total weight of said lubricant and wherein said lubricant is applied at a dry coating weight level of from 250 to 2000 mg/square foot onto said surface.

* * * * *